United States Patent [19]

Ingalls

[11] 4,102,141

[45] Jul. 25, 1978

[54] METHOD OF AND EQUIPMENT FOR USE IN DRIVING COMPOSITE PILES

[75] Inventor: Richard L. Ingalls, South Portland, Me.

[73] Assignee: H. B. Fleming, Inc., South Portland, Me.

[21] Appl. No.: 741,133

[22] Filed: Nov. 11, 1976

[51] Int. Cl.[2] ..... E02D 5/26

[52] U.S. Cl. ..... 61/53.5; 61/53.7; 61/54

[58] Field of Search ..... 61/53, 53.5, 53.7, 54; 175/19, 22; 52/725, 726, 727

[56] References Cited

U.S. PATENT DOCUMENTS

| | | | |
|---|---|---|---|
| 49,362 | 8/1865 | Barnes et al. | 175/22 |
| 1,156,186 | 10/1915 | Shuman | 61/53 |
| 2,525,316 | 10/1950 | Schiff | 175/19 X |

*Primary Examiner*—Jacob Shapiro
*Attorney, Agent, or Firm*—Munroe H. Hamilton

[57] ABSTRACT

A composite pile structure is formed from a lower wooden section and a tubular metal section connected to the wooden member and filled with concrete. The wooden section is first started into the ground a desired distance, and the metal section is then supported on the upper end of the wooden member. A mandrel member is located in driving engagement with the upper end of the metal section and the lower end of the mandrel is supported in spaced relation to the wooden member. Initial hammer energy of limited intensity is applied to drive the metal section into the wooden member until the bottom of the mandrel comes into contact with the top of the wooden member. Thereafter, hammer energy of greater intensity is applied to the connected sections and concentrated against the surface area of the wooden member enclosed by the imbedded metal section. The pile driving operation is rapidly carried on, and splitting of the wooden member is avoided by applying the hammer energy in the manner described.

3 Claims, 4 Drawing Figures

METHOD OF AND EQUIPMENT FOR USE IN DRIVING COMPOSITE PILES

BACKGROUND REFERENCES

U.S. Pat. Nos. 1,865,657 1,916,702 1,971,691 2,782,606 2,821,069 2,874,546 2,912,829 3,003,323.

BACKGROUND OF THE INVENTION

Composite piles having lower sections of wood and an upper tubular section of metal are often used when the piles must extend through a wet layer in order to reach a layer that will support the load. In such cases, the wooden sections are dimensioned to have their upper ends within the wet layer because if they are continuously wet, they have a long life.

In practice, the wooden sections are first started into the ground and with their upper ends above the ground, the metal sections are connected thereto and the composite pile then driven to the desired depth. Usually the metal sections are then filled with concrete.

One problem with such piles is that of effecting a tight joint between their wooden and metal section. This problem has been variously dealt with by incorporating into the composite pile a member that could be driven into the upper end of the wooden section, the member either an integral part of the metal section, see U.S. Pat. No. 2,782,606, for one example, or a separate part that is first driven into the wooden section and the metal section then connected thereto, see U.S. Pat. No. 1,971,691 as another example. In both cases, the member was driven into the wooden section and the two driven together by driving the steel shell. In other cases, the follower or mandrel engaged the member at the bottom of the metal section.

SUMMARIZATION OF THE INVENTION

The present invention is concerned with a composite pile structure of the class noted above and it is a chief object of the invention to devise an improved method and apparatus for connecting a tubular metal pile section with the top of a partly driven wooden pile section. Another object of the invention is to provide a special mandrel construction which can be located in driving relationship with a tubular metal pile section and which can be advanced into contact with the wooden pile section when a desired embedding of the tubular metal section has been achieved. It is also an object of the invention to provide an improved pile driving method which can be very rapidly carried out and which tends to avoid splitting off portions of the wooden pile section.

It has been found that these objectives may be realized in one preferred embodiment of the invention by providing a mandrel member which can be inserted in a tubular metal pile section to be embedded in a wooden pile section. The invention method further provides for supporting the mandrel in driving engagement with the metal section in a position such that the lower end of the mandrel is spaced above the top of the wooden section a distance corresponding to the distance which the metal section is to be driven into the wooden section. Such an arrangement of parts is realized by forming the mandrel with one or more transversely disposed bores through which a pin may be received with extremities thereof projecting outwardly to rest against the top of the tubular metal section.

DETAILED DESCRIPTION OF THE INVENTION

Figure 1:
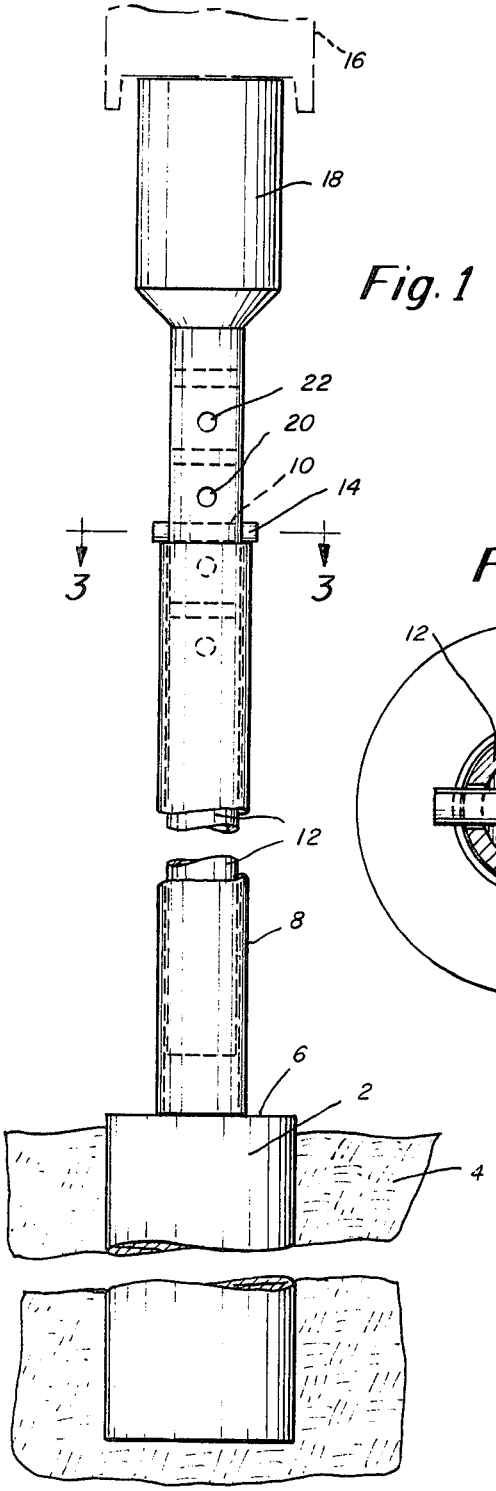
FIG. 1 is a side elevational view indicating a wooden pile section partly driven into the ground and having a tubular metal section received at the upper side thereof and supporting a mandrel member in driving engagement with the top edge of the metal section.
Figure 3:
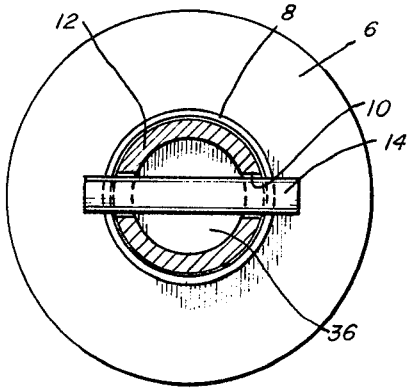
FIG. 3 is a cross section taken on the line 3—3 of FIG. 1.

The apparatus included in the drawings is employed to carry out an improved pile driving method which, in general, includes driving a wooden pile member into the ground, supporting a tubular metal section on an exposed upper end of the wooden member, exerting driving forces of relatively light intensity against a mandrel located in driving engagement with the metal section, thereby to embed the metal section in the wooden pile member a predetermined distance and to move the bottom of the mandrel into contact with the top of the wooden section, thereafter, driving the connected composite pile sections to a desired distance by applying, through the mandrel, pile driver hammer forces of greater intensity concentrated against the upper surface of the wooden pile section enclosed by the embedded metal section.

It will be understood that a desired distance may be a distance sufficient to locate the upper end of the wooden section well within a wet ground layer for the purpose of extending the life of the wooden part. Also the metal section may thereafter be filled with cement.

Considering these steps in more detail, a wooden pile section 2 is first driven into the ground 4 a desired distance to leave exposed upper surface 6 as illustrated in FIG. 1. Thereafter, a tubular metal pile section 8, designed to be embedded in the wooden section is located on the pile surface 6 and supported in substantially coaxial relationship therewith employing a derrick or other hoist means of conventional type, not shown in the drawings. The tubular metal section may occur in varying lengths as required and is preferably of a diameter substantially less than the diameter of the wooden surface 6, and may, for example, have a wall thickness in the order of one quarter of an inch.

In accordance with the invention, a mandrel 12 is first inserted in the tubular section 8 while the latter member is supported in an upright position on the wooden surface 6. An intermediate portion of the mandrel is then located in driving engagement with the upper end of the tubular metal section 8 and with the bottom end of the mandrel 12 occurring in spaced relation to the wooden surface 6. Driving engagement and spacing with respect to the wooden surface 6 and the mandrel bottom is achieved by mounting a heavy bearing pin 14 in a transversely disposed bore 10 in the mandrel with ends of the pin 14 projecting outwardly to rest upon the upper end of the metal section 8, as shown in FIG. 1.

Pile driving hammer forces of relatively light intensity are then exerted by a hammer 16 through the head 18 of mandrel 12. These forces of light intensity operate to embed the lower end of the tubular metal section 8 in the wooden surface 6 a desired distance as suggested diagrammatically in FIG. 2, and at the same time, the bottom of the mandrel 12 is moved downwardly into contact with portions of the wooden surface 6 and enclosed by the embedded extremity of the tubular member 8. Thereafter pile driver hammer forces of greater intensity may be exerted through the mandrel against the wooden surface with which it is in contact, and the composite pile structure is driven to a desired distance such as has been referred to above.

Figure 2:
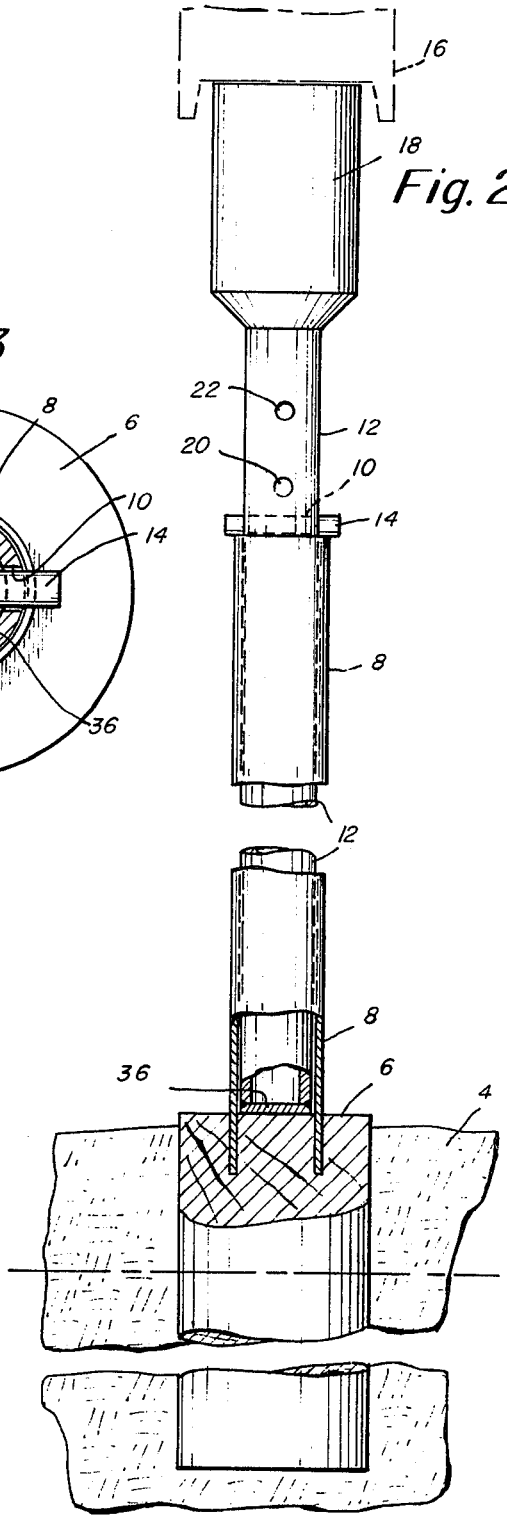
FIG. 2 is an elevational view similar to FIG. 1 and further indicating in partial cross section the tubular metal section having been embedded in the wooden pile section and with the lower end of the mandrel resting against the top of the wooden section.

As will be observed from an inspection of FIGS. 1 and 2, the mandrel 12 may be formed with additional transverse bores as 20 and 22, any one of which may receive the pin 14 therethrough, and there is thereby realized desirable adjustability in the spacing of the lower end of the mandrel 12 with respect to the top of a wooden pile section.

An important feature of this mandrel apparatus disclosed resides in the fact that the bottom of the mandrel may be spaced above a wooden pile section a predetermined distance corresponding to the distance that the lower end of the tubular metal section is to be embedded.

The method of pile driving disclosed may be carried out rapidly and conveniently, and be concentrating pile driver hammer forces of relatively great intensity against the area of the wooden section enclosed by the tubular metal section, splitting of the wooden member may be avoided to a very large extent. The bottom of the mandrel member 12 may be of tubular construction with the bottom end thereof having a cap portion 36 welded thereto, as shown in FIG. 2.

Figure 4:
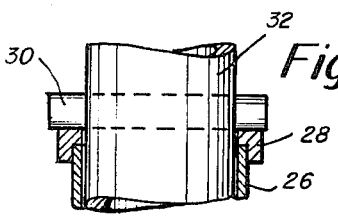
FIG. 4 is a detail cross sectional view illustrating a modified tubular metal construction having a transversely disposed pin resting thereon.

The apparatus may be modified in various ways. For example, as shown in FIG. 4, a tubular metal section 26 may be fitted with a ring member 28 of a radial wall thickness greater than the wall thickness of the metal section to thereby provide a reinforced top bearing surface against which a pin 30, in a mandrel 32, may engage. It may also be desired to support an intermediate portion of a mandrel in other ways as by means of a plurality of pins or by the provision of a collar of increased diameter or in other ways.

I claim:

1. Apparatus for embedding a tubular metal pile section in a wooden pile section and thereafter driving the two sections into the ground a desired distance, said apparatus comprising a mandrel member insertable in the metal tubing and provided with at least one transversely disposed bore, and means for locating the mandrel in driving engagement with the top edge of the tubular section and for spacing the bottom end of the mandrel a predetermined distance above an exposed end of the wooden pile section corresponding to the distance that the lower end of the tubular metal section is to be embedded, said means including a pin member received through said bore for bearing against the top edge of the metal pile section.

2. The apparatus of claim 1 in which the mandrel member is provided with a plurality of transversely spaced bores located therein and spaced apart lengthwise thereof, said pin member engageable through any one of the bores to enable the mandrel member to be located in driving relationship with tubular metal sections of different lengths.

3. The apparatus of claim 1 in which the mandrel locating means also includes a ring member of a radial thickness greater than the thickness of the tubular metal section and dimensioned to rest on the top edge thereof and be engaged by the ends of the pin member.

* * * * *